US007599498B2

(12) United States Patent
Kim et al.

(10) Patent No.: US 7,599,498 B2
(45) Date of Patent: Oct. 6, 2009

(54) APPARATUS AND METHOD FOR PRODUCING 3D SOUND

(75) Inventors: Poong-Min Kim, Daejeon (KR); Hyun-Suk Kim, Daejeon (KR); Jin-Wook Kim, Daejeon (KR); Dong-Woo Lee, Seoul (KR); In-Ho Lee, Daejeon (KR); Yong-Suk Choi, Daejeon (KR); Jeong-Mo Koo, Daejeon (KR); Myung-Cheol Lee, Daejeon (KR); Dong-Sun Shin, Daejeon (KR); Jong-Woo Kim, Jeonrabukdo (KR)

(73) Assignee: Emersys Co., Ltd, Daejeon (KR)

( * ) Notice: Subject to any disclaimer, the term of this patent is extended or adjusted under 35 U.S.C. 154(b) by 953 days.

(21) Appl. No.: 11/175,326

(22) Filed: Jul. 7, 2005

(65) Prior Publication Data

US 2006/0008100 A1 Jan. 12, 2006

(30) Foreign Application Priority Data

Jul. 9, 2004 (KR) ..... 10-2004-0053674

(51) Int. Cl.
*H04R 5/00* (2006.01)

(52) U.S. Cl. ..... 381/17; 381/61

(58) Field of Classification Search ..... 381/17–23, 381/1–4, 61, 63, 300, 303, 309, 11, 12, 310, 381/123, 86; 348/484
See application file for complete search history.

(56) References Cited

U.S. PATENT DOCUMENTS

| | | | | |
|---|---|---|---|---|
| 6,026,169 | A * | 2/2000 | Fujimori | 381/61 |
| 6,567,655 | B1 * | 5/2003 | Wietzke et al. | 455/345 |
| 6,700,980 | B1 * | 3/2004 | Hamalainen | 381/17 |
| 7,466,828 | B2 * | 12/2008 | Ito | 381/86 |

* cited by examiner

*Primary Examiner*—Vivian Chin
*Assistant Examiner*—Lun-See Lao
(74) *Attorney, Agent, or Firm*—Birch, Stewart, Kolasch & Birch, LLP

(57) ABSTRACT

Disclosed herein is an apparatus for producing 3D sound. The apparatus includes a determination unit, a mono sound spreading unit, a stereo sound spreading unit, a selection unit, and a 3D sound accelerator. The determination unit receives a source sound file and determines whether the source sound file is mono or stereo. The mono sound spreading unit converts the source sound into pseudo-stereo sound and performs sound spreading on the pseudo-stereo sound, if the source sound is determined to be mono. The stereo sound spreading unit performs sound spreading on the source sound, if the source sound is determined to be stereo. The selection unit receives the output of the mono sound spreading unit or stereo sound spreading unit, and transfers the output to headphones if the headphone reproduction has been selected. The 3D sound accelerator receives the output from the selection unit if speaker reproduction has been selected, removes crosstalk from the output, and transfers the crosstalk-free output to speakers.

12 Claims, 9 Drawing Sheets

【Fig 1】
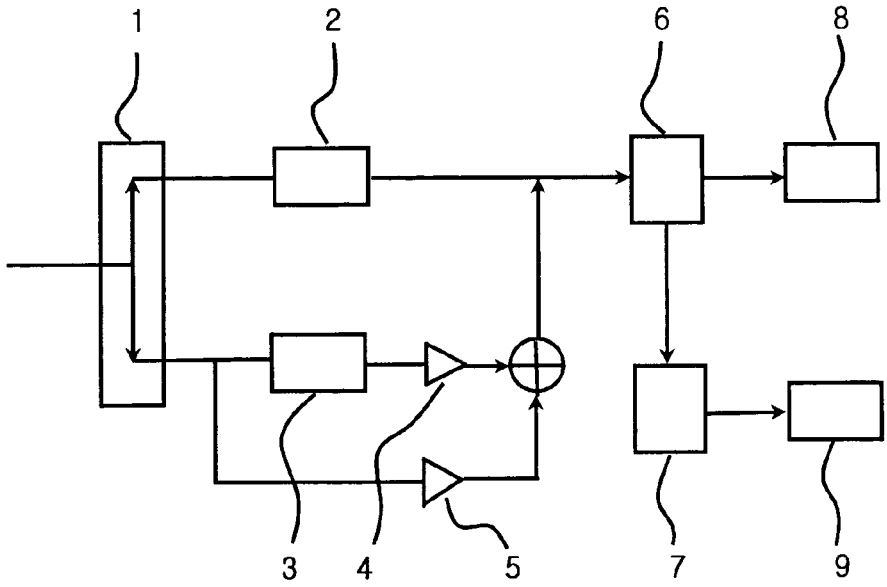

【Fig 2】
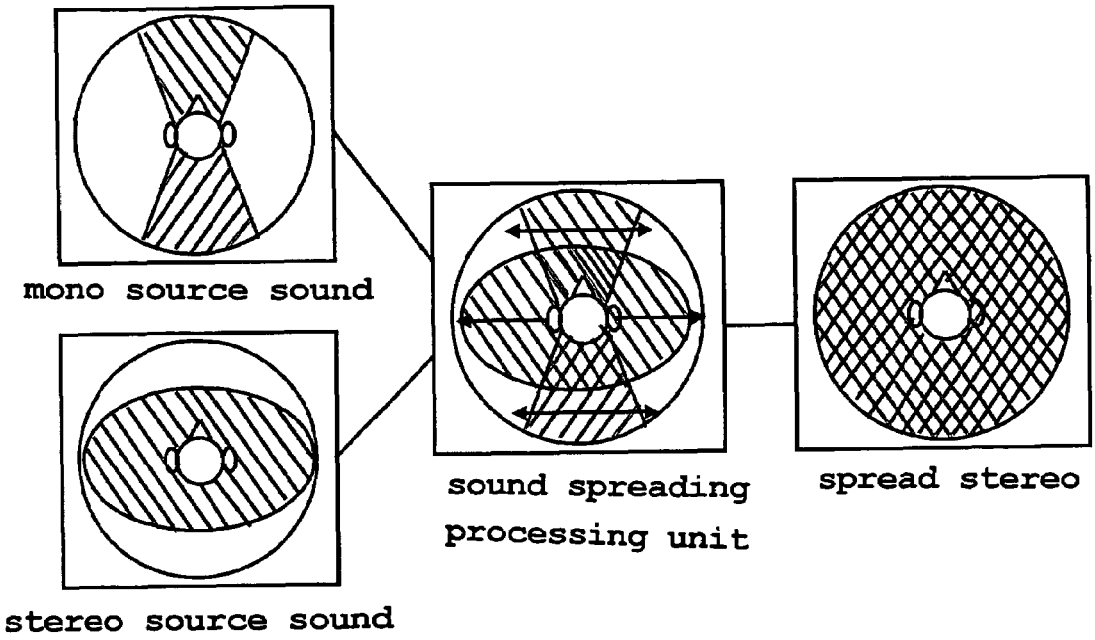

【Fig 3】
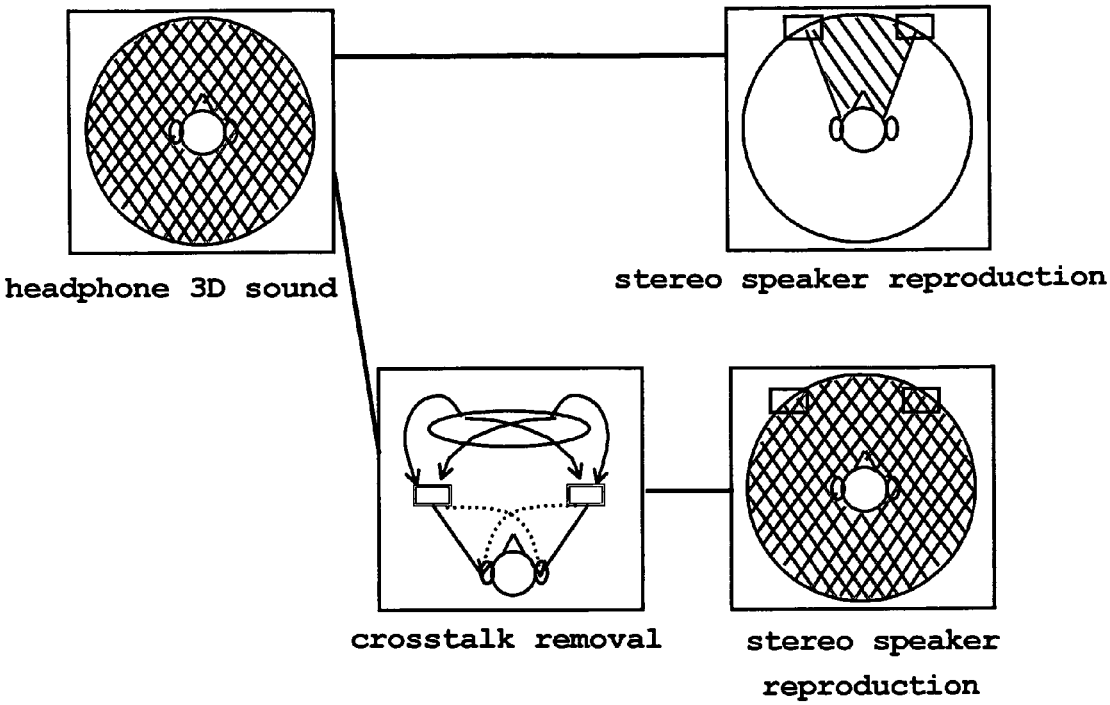

【Fig 4】
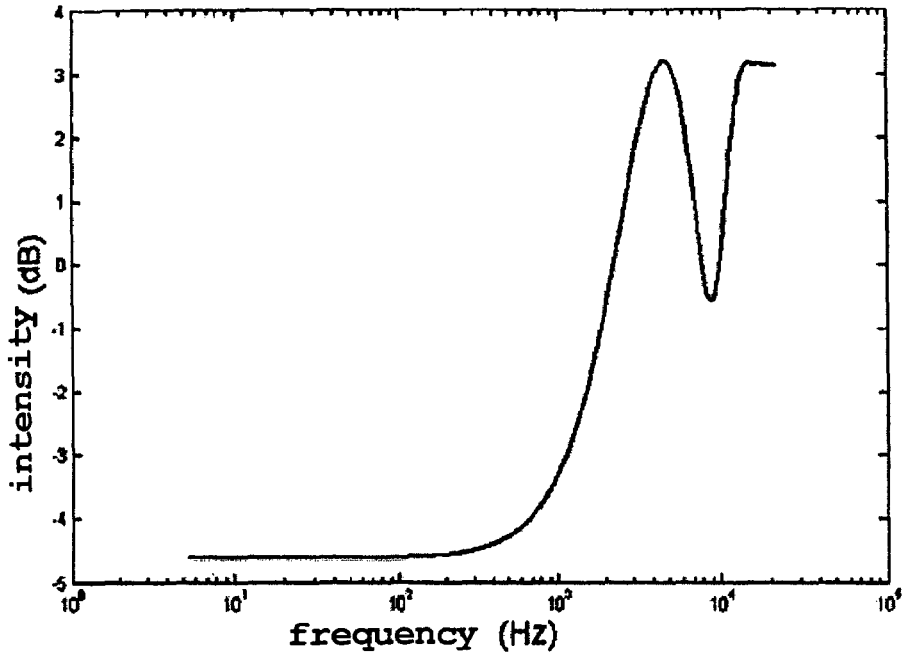
【Fig 5】
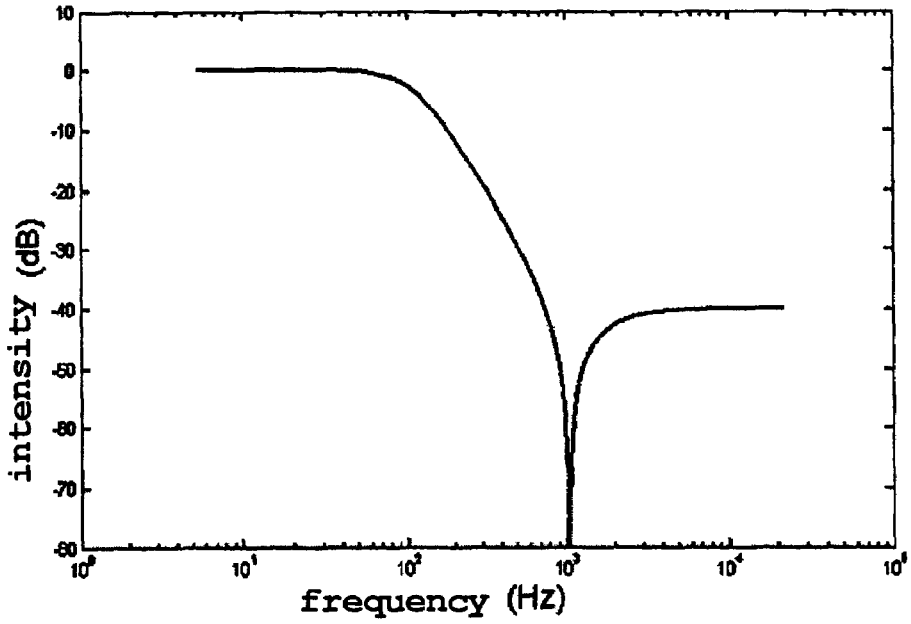

【Fig 6】
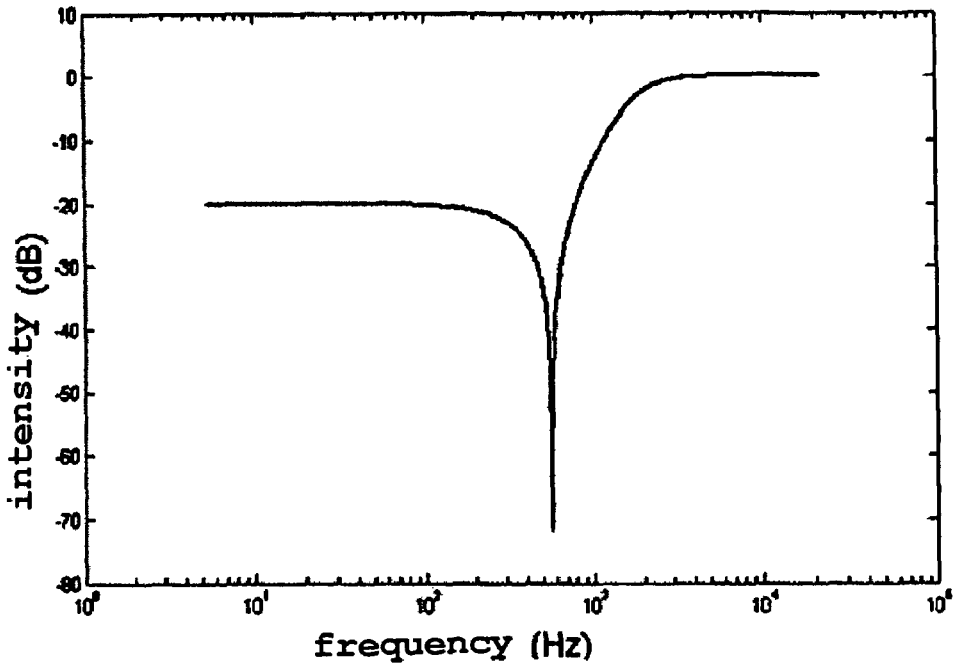
【Fig 7】
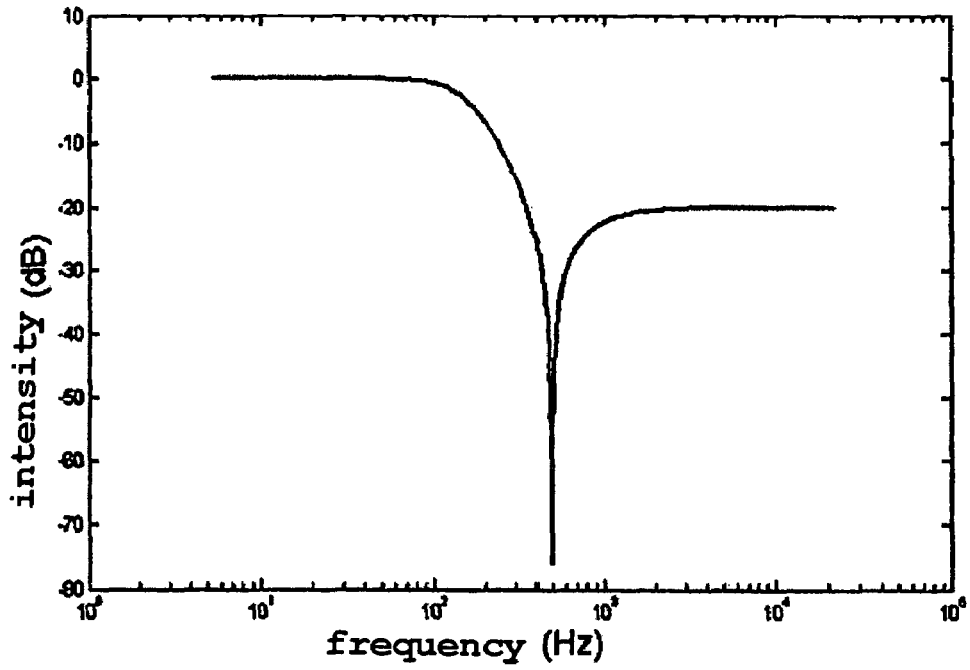

【Fig 8】
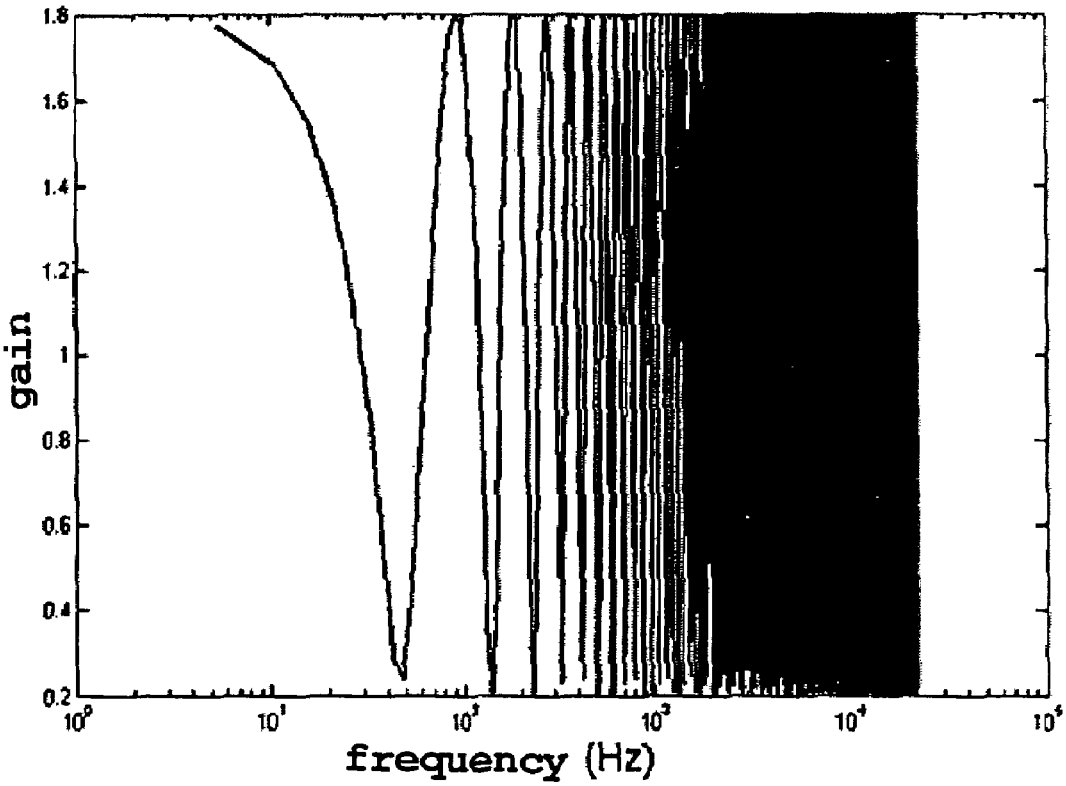

【Fig 9】
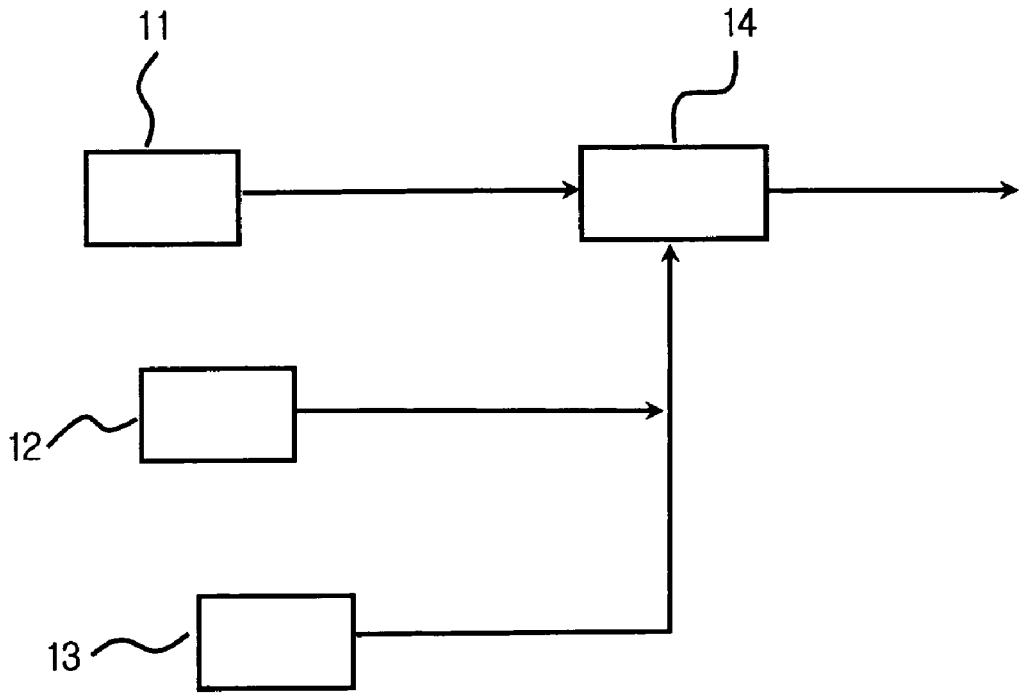

【Fig 10】
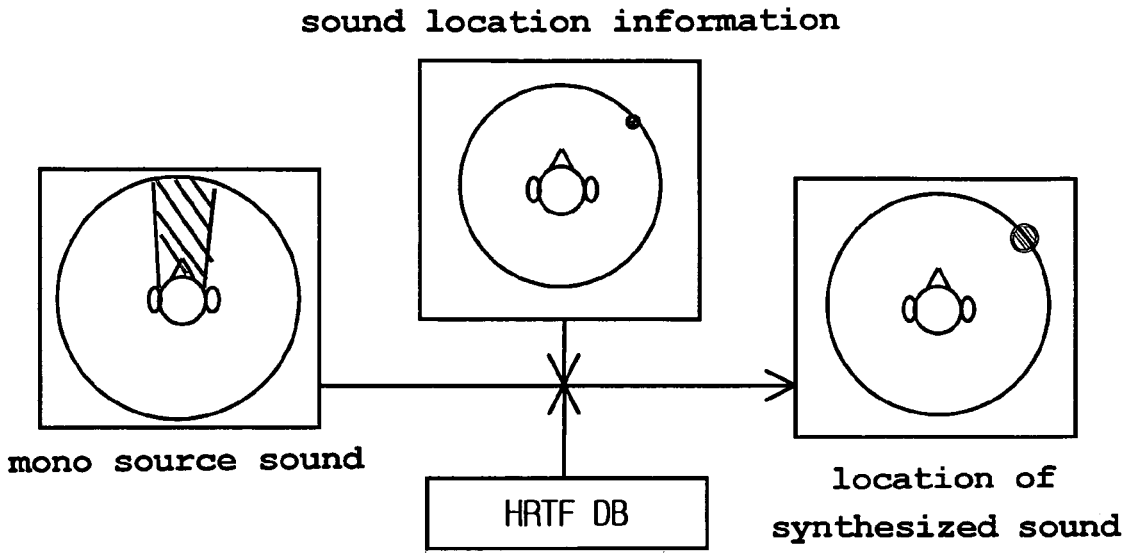

【Fig 11】
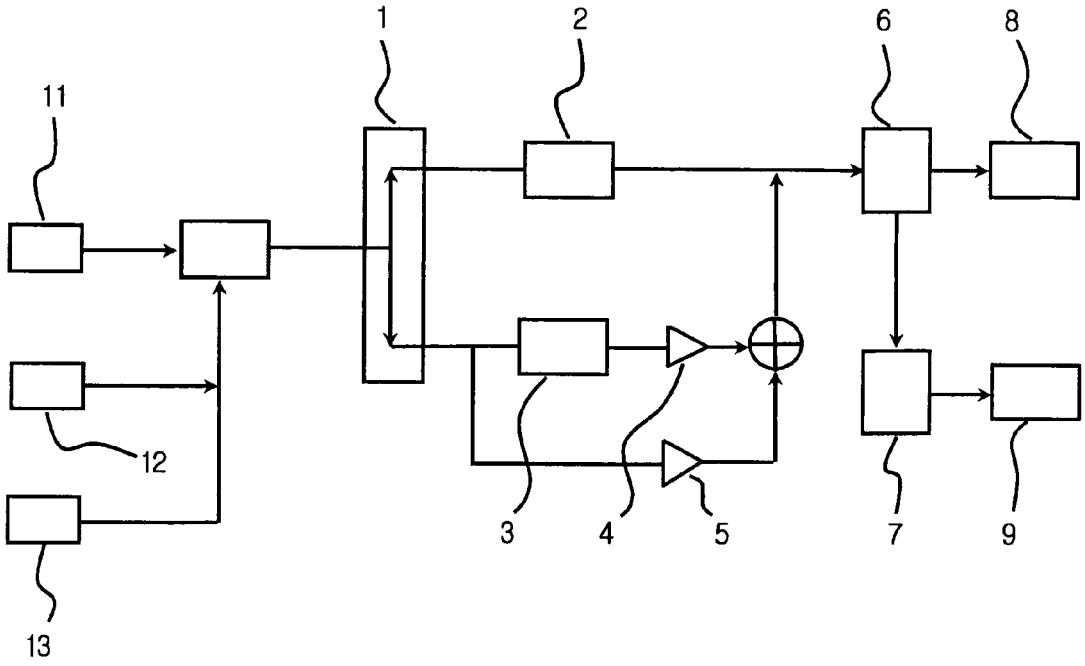

APPARATUS AND METHOD FOR PRODUCING 3D SOUND

BACKGROUND OF THE INVENTION

1. Field of the Invention

The present invention relates generally to an apparatus and method that provide a three-dimensional sound effect at the time of reproducing a source sound file.

2. Description of the Related Art

Since mobile terminals (a mobile phone, a Personal Digital Assistant (PDA), a Moving Picture Experts Group-1 Audio Layer-3 (MP3) phone, etc.) generally have small sizes, small-sized speakers having low output must be mounted therein even if stereo speakers are employed and the distances between the stereo speakers are short, so that it is difficult to reproduce three-dimensional (3D) sound using the stereo speakers mounted in the mobile terminals, unlike the case where sound is reproduced using headphones or general speakers.

In order to overcome the above-described problem, mobile phones capable of reproducing 3D sound do not reproduce general source sound as 3D sound in real time, but employ a method of containing source sound that was previously produced to exhibit a 3-D effect and reproducing the source sound using stereo speakers mounted in the mobile phones.

However, in accordance with the above method, source sound itself must be previously produced to exhibit a 3D effect when reproduced using normal speakers, so that general source sound that was not produced as 3D sound cannot be reproduced as 3D sound using headphones, and the 3D effect thereof is low even when such source sound is listened to through headphones.

As a result, there is no prior art method that can always reproduce sound in 3D form when the sound is listened to using headphones or speakers.

In particular, spreading is necessary to reproduce 3D sound. In the prior art technology, spreading is performed without differentiation between mono source sound and stereo source sound, so that the effect of spreading applied to the mono source sound is low.

In order to localize sound in an arbitrary 3D space, a Head-Related Transfer Function (HRTF) DataBase (DB) is employed, where the HRTF is modeled on the principle that is used by humans to locate sound. The HRTF DB is a DB in which the transfer mechanisms, through which sounds emitted from various locations around a human are transmitted to the human's eardrum, an entrance to the ear, or other parts of the human's auditory organ, are databased. If source sound having no directionality is processed using the HRTF DB, the sensation of a location can be provided to sound (due to sound localization) to allow a human to feel as if sound were generated from a specific location using a headphone reproduction environment.

However, in general, mobile terminals (a mobile phone, a PDA, an MP3 phone, etc.) do not support a method of localizing sound at a location in a 3D space. Furthermore, since source sound files themselves do not have 3D location information, mobile terminals cannot reproduce sound as if sound entities existed at specific locations in a 3D space in conjunction with the location designation of users or the location and movement path designation of games or graphics or as if sound entities moved along a specific movement path, but simply reproduce sound or reproduce sound after applying simple effects thereto.

Accordingly, even when a user or a game/graphic requires a sound effect that localizes a sound in a 3D space or moves a sound in a mobile terminal environment that supports stereo sound, such a sound effect can be realized.

SUMMARY OF THE INVENTION

Accordingly, the present invention has been made keeping in mind the above problems occurring in the prior art, and an object of the present invention is to provide an apparatus and method for producing 3D sound, which enable real-time 3D sound to be reproduced in real time both under headphone reproduction and under speaker reproduction, and allow sound localization to be performed both on mono input and on stereo input, in a mobile phone.

Another object of the present invention is to provide an apparatus and method for producing 3D sound, which enable real-time 3D sound to be reproduced in real time both under headphone reproduction and under speaker reproduction, allow sound localization to be performed both on mono input and on stereo input, and achieve sound localization using a 3D location extracted from game or graphic information and a movement path input by the user, in a mobile phone.

In order to accomplish the above objects, the present invention provides an apparatus for producing 3D sound, including a determination unit for receiving a source sound file and determining whether the source sound file is mono or stereo; a mono sound spreading unit for converting the source sound into pseudo-stereo sound and performing sound spreading on the pseudo-stereo sound if the source sound is determined to be mono by the determination unit; a stereo sound spreading unit for performing sound spreading on the source sound if the source sound is determined to be stereo by the determination unit; a selection unit for receiving the output of the mono sound spreading unit or stereo sound spreading unit, and transferring the output to headphones if the headphone reproduction has been selected as a result of selection of one from between speaker reproduction and headphone reproduction; and a 3D sound accelerator for receiving the output from the selection unit if speaker reproduction has been selected, removing crosstalk, which may occur during the speaker reproduction, from the output, and transferring the crosstalk-free output to speakers.

BRIEF DESCRIPTION OF THE DRAWINGS

The above and other objects, features and advantages of the present invention will be more clearly understood from the following detailed description taken in conjunction with the accompanying drawings, in which:

FIG. 1 is a block diagram showing an apparatus for producing 3D sound in accordance with the present invention;

FIG. 2 is a diagram showing the range of sound after sound spreading has been performed on mono or stereo source sound;

FIG. 3 is a diagram showing the range of sound depending upon whether a 3D sound accelerator is used under speaker reproduction;

FIG. 4 is a graph showing the frequency characteristics of a MEX filter according to the present invention;

FIGS. 5, 6 and 7 are graphs showing the characteristics of M1, M2 and M3 filters according to the present invention;

FIG. 8 is a graph showing the frequency characteristics of a MEX12 filter according to the present invention;

FIG. 9 is a block diagram showing a sound localization device applied to the present invention;

FIG. 10 is a diagram showing a sound localization method applied to the present invention;

FIG. 11 is a block diagram showing the sound localization device of FIG. 9 combined with the 3D sound production apparatus of FIG. 1 in accordance with the present invention.

DESCRIPTION OF THE PREFERRED EMBODIMENTS

Reference now should be made to the drawings, in which the same reference numerals are used throughout the different drawings to designate the same or similar components.

Referring to FIG. 1, an apparatus for producing 3D sound in accordance with the present invention includes a determination unit 1 for receiving a source sound file and determining whether the source sound file is mono or stereo; a mono sound spreading unit 2 for converting the source sound into pseudo-stereo sound and performing sound spreading on the pseudo-stereo sound, if the source sound is determined to be mono by the determination unit 1; a stereo sound spreading unit 3 for performing sound spreading on the source sound if the source sound is determined to be stereo by the determination unit 1; a selection unit 6 for receiving output of the mono sound spreading unit 2 or stereo sound spreading unit 3, and transferring the output to headphones 8 if headphone reproduction has been selected as a result of selection of one from among speaker reproduction and headphone reproduction; and a 3D accelerator 7 for receiving the output from the selection unit 6 if speaker reproduction has been selected, removing crosstalk, which may occur during the speaker reproduction, from the output, and transferring the crosstalk-free output to speakers 9.

A process of producing 3D sound in accordance with the present invention is described with reference to FIG. 1 below.

First, whether a source sound file is mono or stereo is determined in the determination unit 1. If the source sound file is determined to be mono, the source sound of the source sound file is converted into a stereo form and the source sound is diffused using the mono sound spreading unit 2. In contrast, if the source sound file is determined to be stereo, the source sound of the source sound file is diffused using the stereo sound spreading unit 3. In FIG. 2, a sound spreading process using the sound spreading unit is illustrated in detail.

In the case of the stereo file, a signal in which the source sound is spread is generated through the stereo sound spreading unit 3 and passes through a stereo gain unit 4. Meanwhile, when a user does not want sound spreading so as to preserve the fidelity of original sound, a bypassed signal that has not passed through the stereo sound spreading unit 3 passes through a stereo gain system 5. That is, in order to reproduce only the spread region of stereo source sound, the gain of the stereo gain unit 5 is set to '1' and the gain of the stereo gain unit 4 is set to '0'. In contrast, in order to reproduce a spread signal having passed through the stereo sound spreading system 3, the gain of the stereo gain unit 4 is set to '1' and the gain of the stereo gain unit 5 is set to '0'.

Next, a reproduction process is briefly described below.

In the reproduction process, speaker reproduction and headphone reproduction are differently processed. The selection of one of the speaker reproduction and headphone reproduction is performed by the selection unit 6. The selection unit 6 allows the signal to be reproduced according to a reproduction mode selected by the user using the external switch of a portable sound device or a menu on a screen. That is, for the headphone reproduction, the selection unit 6 allows the signal to be reproduced using the headphones without additional processing. In contrast, for the speaker reproduction, the selection unit 6 causes the signal to pass through a special signal processing unit (the 3D sound accelerator 7 to be described later) and then be produced using the speakers 9.

That is, since the sound output from the stereo sound spreading unit 3 has been produced for headphone reproduction, the user can experience 3-D sensation when listening to the sound using the headphones 8. If the sound is output through the speakers 9 without additional processing, a sound image is formed only between the user's head and two speakers due to crosstalk, that is, interference caused by signals that propagate from the speakers 9 to the user's ear and become partially superimposed on each other, so that the quality of 3D sound is degraded in a speaker reproduction environment. Accordingly, in order to remove a crosstalk signal component, a signal capable of canceling crosstalk, together with the output of the two speakers 9, is output at the time of outputting the sound. Through this process, the user can hear 3D sound through the speakers 9, as illustrated in the lower portion of FIG. 3.

The above-described determination unit 1, mono sound spreading unit 2, stereo image spreading unit 3, and 3D sound accelerator 7 for speakers can be implemented using various methods known to those skilled in the art. However, in order to provide superior performance, the constructions of the determination unit 1, the mono sound spreading unit 2, the stereo image spreading unit 3, and the 3D sound accelerator 7 for speakers that are invented by the present applicant are described in detail below.

A mono/stereo detector is provided in the determination unit 1. When a signal is determined to be mono data by the mono/stereo detector, a sound image is formed in the center. Accordingly, the signal is separated in a frequency domain by a preprocessor, and is processed using the following Equation 5 to allow a sound image to be formed across side portions. Data in a frequency domain that is not used in the following processing are compensated for delay, which occurs in MEX processing, in a postprocessor, and are mixed.

Now, the stereo sound spreading unit 3 is described below.

The sensation of spreading generally increases as the absolute value of the correlation coefficient between the data of two side stereo channels approaches zero. The correlation efficient refers to the extent to which common part exists between two pieces of data. When the correlation coefficient is 1, the correlation coefficient indicates that the two pieces of data are absolutely the same. When the correlation coefficient is −1, the correlation coefficient indicates that the two pieces of data have the same absolute value and oppositely signed values. When the correlation coefficient is 0, the correlation coefficient indicates that the two pieces of data are absolutely different.

Stereo sound spreading is a process of reducing the correlation between two channels by an appropriate audio filter to an audio signal in consideration of a human's auditory sense related to the sensation of stereo sound. However, when an audio signal, having passed through mastering, passes through an additional audio filter, the intention of the original author can be damaged, so that a method of adjusting the intensity of spreading must be provided.

In order to adjust the extent of preservation of original sound, a method of adding the absolute value of a correlation coefficient to input data, that is, emphasizing only the different portions of two pieces of data, rather than passing all the input data through the stereo spreading filter (hereinafter referred to as a "MEX filter"), in the spreading process of the present invention (hereinafter referred to as "MEX"), is employed. This method can be expressed by the following Equation 1.

$$L=((L+R+(L-R))/2$$

$$R=((L+R-(L-R))/2 \quad (1)$$

In Equation 1, L and R are left channel input data and right channel input data, respectively, L+R is the sum of the two pieces of data, and L−R is the difference between the two pieces of data.

In order to perform spreading with L and R signals used as input and L_processed and R_processed used as output, Equation 2 having a general form may be employed. In Equation 2, Mp designates an MEX filter that is applied to an L+R signal, and Mm designates an MEX filter that is applied to an L−R signal. When each gain increases in Equation 2, a sensation that the user feels is as follows:

When G_orig increases, the intention with which the source sound was mastered is followed.

When G_plus increases, the forefront portion of a sound image is strengthened.

When G_minus increases, the sensation of spreading increases.

$$L_\text{processed}=G_\text{orig}*L+G_\text{plus}*Mp(L+R)+G_\text{minus}*Mm(L-R)$$

$$R_\text{processed}=G_\text{orig}*R+G_\text{plus}*Mp(L+R)-G_\text{minus}*Mm(L-R) \quad (2)$$

From Equation 2, it can be understood that (L+R) is a portion in which the correlation coefficient between two channels is 1 and (L−R) is data in which the correlation coefficient is −1. (L+R) is a portion that the two channels have in common. Since the manipulation of (L+R) functions to increase the correlation between the two channels, the application of the MEX filter only to (L−R) may be taken into consideration first so as to emphases the spreading effect.

Furthermore, because the combination of only a common portion and a portion in which spreading is emphasized may affect the initial intention with which stereo mastering was performed, an original signal must be synthesized. The extent of preservation of original sound can be adjusted by filtering only a small portion of data. The MEX data processing using the above method is performed with the processing on (L+R) excluded from FIG. 2, which is expressed by the following Equation 3.

$$L_\text{processed}=G_\text{orig}*L+G_\text{plus}*(L+R)+G_\text{minus}*M(L-R)$$

$$R_\text{processed}=G_\text{orig}*R+G_\text{plus}*(L+R)-G_\text{minus}*M(L-R) \quad (3)$$

In Equation 3, L_processed and R_processed are data on which MEX processing was performed, G is gain, and M( ) indicates that the MEX filter was applied.

The MEX filter must have the characteristic of providing the desired sensation of spreading while emphasizing the difference between two channels and not causing a listener discomfort. According to the test results of the present applicant, it is desirable that the MEX filter have the frequency characteristics illustrated in FIG. 4. Since the sound in question is sensed by humans, the desired sound is experienced differently by different humans, so that the designer of the MEX filter must determine an appropriate characteristic curve through a plurality of experiments. With the assistance of such a MEX filter, the difference between two channel data is maximized.

Meanwhile, in the MEX process based on Equation 3, only the difference component in a high frequency sound region is emphasized. There may occur cases where the difference between two channels may be heard as sound having high dispersion from the viewpoint of auditory sensation. Furthermore, since only the high frequency sound region is emphasized, there is concern for the destruction of the musical balance throughout the entire frequency band.

In order to overcome the above-described problems, the following Equation 4 can be used to achieve both spreading in high and low frequency sound regions and the balance of sound volume by, like Equation 3 from Equation 2, assigning the filters M1 and M2, which are used for sum components, to high and low frequency sound regions and performing spreading in both high and low frequency sound regions.

$$L_\text{processed}=G_\text{orig}*L+(G_\text{plus1}*M1(L+R)+G_\text{plus2}*M2(L+R)+G_\text{static1}*(L+R))+(G_\text{minus}*M3(L-R)+G_\text{static2}*(L-R))$$

$$R_\text{processed}=G_\text{orig}*R+(G_\text{plus1}*M1(L+R)+G_\text{plus2}*M2(L+R)+G_\text{static1}*(L+R))-(G_\text{minus}*M3(L-R)+G_\text{static2}*(L-R)) \quad (4)$$

In Equation 4, L_processed and R_processed are data on which MEX processing was performed, G_orig, G_plus1, G_plus2, G_static1, G_minus and G_static2 are gains, M1( ) and M2( ) indicate that an MEX filter for an L+R signal was applied, and M3 indicates that an MEX filter for an L−R signal was applied.

According to the test results of the present applicant, it is desirable that filters M1, M2 and M3 have the frequency characteristics of FIGS. 5, 6 and 7, respectively. However, as described above, since the sound in question is sensed by humans, the sound is differently experienced by different humans, so that the designer of the MEX filter must determine appropriate characteristic curves through a plurality of experiments.

Next, the mono sound spreading unit 2 is described below.

When data in question are determined to be mono data by the mono/stereo detector of the determination unit 1, the mono sound spreading unit 2 converts the mono data into pseudo-stereo data and subsequently perform a spreading process.

Methods of generating pseudo-spreading stereo sound include various known methods. The methods have the defect of causing listeners discomfort, shifting a sound image to right or left side, or having a poor effect. The mono sound spreading filter (MEX12) of the present invention is invented to provide a great sensation of spreading while making up for the above-described defects.

According to the test results of the present applicant, it is desirable that the MEX12 filter have the frequency characteristics illustrated in FIG. 8. Since the sound in question is sensed by humans, desired sound is differently experienced by different humans, so that the designer of the MEX12 filter must determine an appropriate characteristic curve through a plurality of experiments. Data, in which some frequency bands are strengthened and the remaining bands are attenuated by the application of a MEX12 filter, which has the frequency characteristics shown in FIG. 8, to mono source sound, are used as data for a right channel. Thereafter, a constant multiple of the source sound is compensated for delay caused by the MEX12 filter, and a value obtained by subtracting the data for a right channel from the multiple is used as data for a left channel. This is expressed as the following Equation 5.

$$\text{Pseudo_}R=M12(\text{Mono})$$

$$\text{Pseudo_}L=\text{Mono}*Km-\text{Pseudo_}R \quad (5)$$

In Equation 5, M12 indicates that a MEX12 filter was applied, Mono indicates source sound, and Km indicates a constant.

Finally, the 3D sound accelerator 7 is described below.

As described above, when the sound (in FIG. 1, the sound passed through the mono sound spreading unit 2, the sound passed through the stereo sound spreading unit 3, or the sound having bypassed the stereo sound spreading unit 3 is reproduced using the speaker 9, a process of removing crosstalk using the 3D sound accelerator 7 (hereinafter referred to as "eXTX") is necessary. The case where a speaker has two channels, that is, right and left channels, is described below for ease of description.

The filter Q used in eXTX has two inputs and two outputs, and can be derived as follows. 3D source sound X is finally heard as sound pressure d by a listener through a speaker output V, where an equation relating sound pressure at a speaker and sound pressure at the ear is expressed in the following Equation 6.

In the following Equation 6, Hv is the speaker output of a transaural system that is considered to be equal to sound pressure d at the ear, A is signal characteristics along the shortest path from the speaker to two ears of a human, and S is signal characteristics along a long path, that is, crossing signal characteristics.

$$d = Hv = \begin{bmatrix} A & S \\ S & A \end{bmatrix} \begin{bmatrix} V_L \\ V_R \end{bmatrix} \tag{6}$$

In the case of headphone listening, an equation relating input 3D sound and sound at the ear is expressed as the following Equation 7.

$$\begin{bmatrix} d_L \\ d_R \end{bmatrix} = \begin{bmatrix} x_L \\ x_R \end{bmatrix} \tag{7}$$

In Equation 6, x is a signal for headphones, which is sound pressure at the ear.

In the case of speaker listening, an equation relating input 3D sound and sound at the ear is expressed in the following Equation 8.

$$\begin{bmatrix} V_L \\ V_R \end{bmatrix} = \begin{bmatrix} x_L \\ x_R \end{bmatrix} \tag{8}$$

$$\begin{bmatrix} d_L \\ d_R \end{bmatrix} = \begin{bmatrix} A & S \\ S & A \end{bmatrix} \begin{bmatrix} V_L \\ V_R \end{bmatrix}$$

As a result, the filter Q of eXTX, which is composed of the inverse function of a transaural system for removing crosstalk so as to obtain the same result as in the headphones, at the time of speaker listening, is expressed by the following Equation 9.

$$Q = \begin{bmatrix} A & S \\ S & A \end{bmatrix}^{-1} \tag{9}$$

In eXTX, Q is implemented using the distance spkD between right and left speakers and the distance between the speakers and the center of the axis of the listener's ear. The length of a direct path, along which a signal propagates from a right speaker to the right ear and from a left speaker to the left ear, and the length of a cross path, along which a signal propagates from the right speaker to the left ear and from the left speaker to the right ear, are calculated using a HRTF model, and signal processing is performed by applying parameters "a" and "b" that are extracted from the HRTF model, the equation of which is expressed as follows:

$$\begin{bmatrix} y_L \\ y_R \end{bmatrix} = \frac{1}{1 - g \cdot a^2 \cdot z^{-2b}} \begin{bmatrix} A_L & a \cdot z^{-b} \\ a \cdot z^{-b} & A_R \end{bmatrix} \begin{bmatrix} x_L \\ x_R \end{bmatrix} \tag{10}$$

In Equation 10, parameter "a" is the gain ratio between the direct path and the cross path, parameter "b" is the delay between the direct path and the cross path, and $A_R$ and $A_L$ are correction filters for the direct path extending from the right speaker to the right ear and the direct path extending from the left speaker to the left ear.

In accordance with the above-described method of the present invention, the real-time reproduction of 3D sound can be achieved both under headphone reproduction and under speaker reproduction, and sound spreading can be performed on both mono input and stereo input.

Next, the construction of a sound system that can produce 3D sound, in which sound localization is realized, using the 3D sound production method of the present invention is described with reference to FIGS. 9 to 11 below.

A sound localization method is described with reference to FIG. 9.

In order to localize sound at a desired location (achieve sound localization), source sound 11 is converted into sound, which is localized in a 3D space, through a 3-D sound synthesizer 14 using 3D location information 12 by the user or location information 13 mapped to a game or graphic.

In the 3D sound synthesizer 14, sound is produced using 3D coordinate information so that the sound can be localized in a 3D space, as shown in FIG. 10. FIG. 10 illustrates a method of producing sound to allow the sound to be localized in a 3D space. In this method, when general source sound having no location information is input, coordinate values are obtained as an azimuth angle and an elevation angle, which can search the HRTF DB for data having corresponding location information, based upon the user's input or 3D coordinate information in a sound location information block, and convolution operation is performed on the corresponding location data obtained from the HRTF DB and the source sound using the values. As a result, a sound image can be formed at a designated location in a sound location information block like the location block of synthesized sound.

An example in which the sound localization apparatus described above is applied to a 3D sound system is illustrated in FIG. 11. When source sound is localized based on location information 12 and 13 using the 3D sound synthesizer 14, whether the source is mono or stereo is determined by the determination unit 1, and the source sound is converted into 3D sound as set forth in the description related to FIGS. 1 to 8, so that both sound localization and 3D sound are achieved at the same time.

Although the preferred embodiments of the present invention have been described, the present invention is not limited to these embodiments, but can be variously modified with a range that does not deviate from the spirit of the present invention.

For example, although the present invention has been described as being applied to a mobile terminal, the present invention can be applied to the sound processing units of various media devices, such as sound devices (audio devices, mini-component audio devices, cassette players, etc.) and image devices (televisions, camcorders, etc.).

In accordance with the above-described method of the present invention, the real-time reproduction of 3D sound can be achieved both under headphone reproduction and under speaker reproduction, and sound spreading can be performed on both mono input and stereo input.

Furthermore, in accordance with the above-described method of the present invention, the real-time reproduction of 3D sound can be achieved both under headphone reproduction and under speaker reproduction, sound spreading can be performed on both mono input and stereo input, and sound localization can be achieved using a 3D location extracted from gain/graphic information and a movement path input by the user.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for producing three-dimensional (3D) sound, comprising:

a determination unit for receiving a source sound file and determining whether the source sound file is mono or stereo;

a mono sound spreading unit for converting the source sound into pseudo-stereo sound and performing sound spreading on the pseudo-stereo sound, if the source sound is determined to be mono by the determination unit;

a stereo sound spreading unit for performing sound spreading on the source sound, if the source sound is determined to be stereo by the determination unit;

a selection unit for receiving output of the mono sound spreading unit or stereo sound spreading unit, and transferring the output to headphones if the headphone reproduction has been selected as a result of selection of one from between speaker reproduction and headphone reproduction; and a 3D sound accelerator for receiving the output from the selection unit if speaker reproduction has been selected, removing crosstalk, which may occur during the speaker reproduction, and transferring the crosstalk-free output to speakers;

wherein the stereo sound spreading unit adjusts the intensity of spreading by applying the following equation:

```
L_processed=G_orig*L+(G_plus1*M1(L+R)+
    G_plus2*M2(L+R)+G_static1*(L+R))+
    (G_minus*M3(L−R)+G_static2*(L−R))

R_processed = G_orig*R+(G_plus1*M1(L+R)+
    G_plus2*M2(L+R)+G_static1*(L+R)) −
    (G_minus*M3(L−R)+G_static2*(L−R)); and
```

wherein, L_processed and R_processed are data on which MEX processing was performed, G_orig, G_plus1, G_plus2, G_static1, G_minus and G_static2 are gains, M1( ) and M2( ) indicate that an MEX filter for an L+R signal was applied, and M3 indicates that an MEX filter for an L−R signal was applied.

2. The apparatus as set forth in claim 1, wherein the mono sound spreading unit employs a filter (MEX12) that has characteristics in which gain vibrates according a frequency and a vibration frequency of the gain increases with an increase of the frequency.

3. The apparatus as set forth in claim 1, further comprising a sound localization device comprising:

location information reception unit for receiving location information for localizing source sound; and a 3D sound synthesizer for performing conversion so that a sound image can be formed at a desired location, using the source sound, the location information received by the location information reception unit and a Head-Related Transfer Function (HRTF) DB.

4. The apparatus as set forth in claim 3, wherein a location of the input location is on a movement path and varies with time.

5. The apparatus as set forth in claim 3, wherein the location information is input by a user.

6. The apparatus as set forth in claim 1, wherein the 3D sound formation apparatus is used for a sound processing unit of a mobile terminal.

7. A method of forming 3D sound, comprising: the determination step of receiving a source sound file and determining whether source sound of the source sound file is mono or stereo; the mono sound spreading step of, if the source sound is determined to be mono, converting source sound into pseudo-stereo sound and performing sound spreading on the pseudo-stereo sound; the stereo sound spreading step of, if the source sound is determined to be stereo, performing sound spreading on the source sound; the selection step of receiving output from the mono sound spreading step or stereo sound spreading step, and transferring the output to headphones if headphone reproduction is selected as a result of selection of one from between speaker reproduction and headphone reproduction; and the 3D acceleration step of, if speaker reproduction is selected at the selection step, removing crosstalk, which may occur when the output is reproduced using speakers, and transferring the crosstalk-free output to the speakers; wherein the stereo sound spreading step adjusts the intensity of spreading by applying the following equation:

```
L processed =G orig*L+(G plus1*M 1 (L+R)+G
    plus2*M2(L+R)+ G static1*(L+R))+(G
    minus*M3(L−R)+G static2*(L−R)) R
    processed =G orig*R+(G plus1*M1 (L+R)+G
    plus2*M2(L+R)+ G static1*(L+R))−(G
    minus*M3(L−R)+G static2*(L−R));
```

and wherein, L processed and R processed are data on which MEX processing was performed, G orig, G plus1, G plus2, G static1, G minus and G static2 are gains, M1( ) and M2( ) indicate that an MEX filter for an L+R signal was applied, and M3 indicates that an MEX filter for an L−R signal was applied.

8. The method as set forth in claim 7, further comprising the sound localization step comprising:

the localization information reception step of receiving location information that is used to locate the source sound at a desired location; and the 3D sound synthesizing step of performing conversion so that a sound image can be at a desired location, using the source sound, the location information input at the location information reception step, and a HRTF DB.

9. The method as set forth in claim 8, wherein a location of the input location information is on a movement path and varies with time.

10. The method as set forth in claim 8 wherein the location information is input by a user.

11. The method as set forth in claim 8, wherein the location information is input from graphic information of a game.

12. The method as set forth in claim 8, wherein the 3D sound formation method is used for a sound processing unit of a mobile terminal.

* * * * *

UNITED STATES PATENT AND TRADEMARK OFFICE

CERTIFICATE OF CORRECTION

PATENT NO. : 7,599,498 B2
APPLICATION NO. : 11/175326
DATED : October 6, 2009
INVENTOR(S) : Poong-Min Kim et al.

It is certified that error appears in the above-identified patent and that said Letters Patent is hereby corrected as shown below:

ON THE COVER PAGE:

Item (30) Foreign Application Priority Data, please add --July 9, 2004 (KR) 10-2004-0053673--.

Signed and Sealed this

Twenty-second Day of December, 2009

David J. Kappos

David J. Kappos
*Director of the United States Patent and Trademark Office*